United States Patent [19]

Riggins et al.

[11] Patent Number: 4,898,596

[45] Date of Patent: Feb. 6, 1990

[54] EXHAUST PROCESS FOR SIMULTANEOUSLY DYEING AND IMPROVING THE FLAME RESISTANCE OF ARAMID FIBERS

[75] Inventors: Phillip H. Riggins; Peter J. Hauser, both of Greensboro, N.C.

[73] Assignee: Burlington Industries, Inc., Greensboro, N.C.

[21] Appl. No.: 295,001

[22] Filed: Jan. 9, 1989

Related U.S. Application Data

[63] Continuation of Ser. No. 139,761, Dec. 30, 1987, abandoned.

[51] Int. Cl.[4] ..... D06P 5/00

[52] U.S. Cl. ..... 8/490; 8/130.1; 8/572; 8/925

[58] Field of Search ..... 8/49 D, 572

[56] References Cited

U.S. PATENT DOCUMENTS

| | | | |
|---|---|---|---|
| 4,198,494 | 4/1980 | Burckel | 525/432 |
| 4,324,706 | 4/1982 | Tabe et al. | 524/15 |
| 4,525,168 | 6/1985 | Kelly | 8/130.1 |
| 4,583,986 | 4/1986 | Lapidus et al. | 8/405 |
| 4,710,200 | 12/1987 | Cates et al. | 8/574 |
| 4,759,770 | 7/1988 | Cates et al. | 8/490 |

*Primary Examiner*—A. Lionel Clingman

*Attorney, Agent, or Firm*—Nixon & Vanderhye

[57] ABSTRACT

Aramid and aramid-blend fabrics are dyed and optionally flame-retardant treated using conventional pressure and heat dyeing equipment. Odor-free, colored or colored and highly flame resistant products result.

16 Claims, No Drawings

EXHAUST PROCESS FOR SIMULTANEOUSLY DYEING AND IMPROVING THE FLAME RESISTANCE OF ARAMID FIBERS

This is a continuation of application Ser. No. 139,761, filed Dec. 30, 1987, now abandoned.

This invention relates to dyeing aramid fibers and simultaneously improving the flame resistance of these fibers. Aramids and aramid blends are dyed and optionally also flame-retardant-treated in conventional pressure dyeing equipment to produce an odor-free, colored, or colored and highly flame resistant, product.

BACKGROUND OF THE INVENTION

Aramid fibers are highly resistant to heat decomposition, have inherent flame resistance, and are frequently used in working wear for special environments where flame resistance is required. Fabrics made of these fibers are extremely strong and durable, and have been widely adopted for military applications where personnel have the potential to be exposed to fire and flame, such as aircraft pilots, tank crews and the like. There is a need for dyed fabrics that have flame-resistant properties even greater than the undyed fabrics or dyed fabrics. Meta-linked aromatic polyamide fibers (aramid fibers) are made from high-molecular-weight polymers that are highly crystalline and have either a high or no glass transition temperature.

These inherent desirable properties of aramid fibers also create difficulties for fiber processing in other areas, specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths.

Polar organic solvents have also been used to swell the fiber or create voids in the fiber structure to enhance dyeability. These procedures involve solvent exhaust treatments at elevated temperatures with subsequent dyeing. Another source of dyed aramid fiber is solution-dyed aramid yarn, available from the producer, prepared by solution dyeing in which a quantity of dye or pigment is mixed with the molten or dissolved polymer prior to extrusion of the polymer or solution into fine fibers; the dye or pigment becomes part of the fiber structure. Solution-dyed fibers are more costly than the undyed fibers due, in part, to the additional costs of manufacture, and must be used in the color provided by the supplier, leaving the user with only a limited choice of colors. Solution-dyed fibers offer relatively good lightfastness, whereas some undyed aramid fibers, particularly Nomex® (DuPont), yellow following exposure to UV light. Because of this potential for yellowing, although deep, rich colorations, particularly dark blue and navy blue, are achievable, they still lack acceptable lightfastness.

More recently, a process has been described in U.S. Pat. No. 4,525,168 in which acid or anionic dyes are introduced into aramid fibers by coupling the dye to a dye site receptor which, in turn, is attached to the fiber. The process includes first swelling the fiber in a strong polar solvent and, while the fiber is in the swollen condition, introducing a substance capable of forming a strong chemical bond with an anionic dye into the swollen fiber. This dye site receptor substance is an amine, typically hexamethylenediamine. The procedure described requires at least three steps: first pretreating the fiber in a solution of solvent/swelling agent; treating with the diamine and a wetting agent; then drying to shrink the fiber and incorporate the diamine dye site receptor into the fiber. The thus-pretreated fabric is then dyed with an anionic dye. Aramid fibers described and purported to be successfully dyed in U.S. Pat. No. 4,198,494 are sold under the trademarks Nomex® and Kevlar® by DuPont, and under the trademark Conex® by Teijin Limited of Tokyo, Japan.

A process has been used by Cates and others in commonly-assigned U.S. patent application Ser. No. 870,523 filed June 4, 1986, now U.S. Pat. No. 4,710,200 for the continuous or semi-continuous dyeing of and simultaneous improving the flame-resistant properties of poly(m-phenyleneisophthalamide) fibers that includes the step of introducing the fiber into a fiber swelling agent solution also containing at least one dye together with at least one flame retardant, thereby swelling the fiber and introducing both the dye and the flame retardant into the fiber while in the swollen state. The flame resistance/performance properties of fabrics dyed by this process are significant. LOI values, as described below, may be as high as 44% for simultaneously dyed and flame retarded T-455 Nomex fabric product produced by the process of this invention. As a means of comparison, undyed T-455 Nomex has an LOI of 27%. However, this process involves some equipment not routinely available on most existing processing lines.

It is an object of the present invention to provide a process for dyeing an aramid fiber such as Nomex®. It is also an object to provide a process for simultaneously dyeing and not detracting from the inherent strength of the aramid fibers. It is also an object to provide a process suitable to conventional equipment such as pressure jets, or similar machines. It is particularly an object to provide a process for the preparation of dyed, "super FR" Nomex® fabrics of high LOI of 37%–44% as described in the Cates et al patent application.

SUMMARY OF THE INVENTION

Disclosed is a process for dyeing, or if preferred, both dyeing and simultaneously improving the flame-resistant properties of poly(m-phenyleneisophthalamide) fibers. The process includes the steps of introducing the fiber into a fiber dyeing solution containing a tinctorial amount of at least one dye together with N-cyclohexyl-2-pyrrolidone (CHP) as a diffusion promoter, and at least one flame retardant, especially chloroalkyl diphosphate esters such as Antiblaze 100, optionally also containing sodium nitrate, then heating the fiber and solution at a temperature and for a sufficient period of time to dye and flame retardant treat (when present) the fibers.

Our experience indicates that the N-cyclohexyl derivative of 2-pyrrolidone is the only dye diffusion agent effective for this process. The N-methyl and N-ethyl analogs were tried, but they performed poorly with respect to depth of dyeing and durability of the color to laundering, hence the described process is specific to the use of N-cyclohexyl-2-pyrrolidone.

Dyeing is always conducted above room temperature, conveniently in the range of about 120° C. to about 150° C., at a pressure above atmospheric and for a time sufficient to achieve the desired coloration, usually from about 15 minutes up to 2 to 3 hours. Time and temperature are related, and we have found best results to be at about 130° C. for a period of about one hour.

Flame retardants are applied in a range of about 3% to about 20% based on weight of fabric for the exemplified flame retardant Antiblaze 100, with a preferred range of from 6% to 15%, and a most preferred range of from 6% to 9%.

It will be apparent that variations on this process are possible, such as use of other flame retardants, or other temperatures or times.

The flame resistance/performance properties of fabrics dyed by the process of this invention are significantly improved, far better than if aftertreated with a flame-retardant (FR) finish applied from an aqueous solution following the dyeing and fixing operation. Limiting Oxygen Index (LOI) values, as described in more detail below, may be as high as 41% for the simultaneously dyed and flame retarded T-455 Nomex® fabric product produced by the process of this invention. As a means of comparison, undyed T-455 Nomex® has an LOI of 27%.

Both dyeing and flame retarding are affected by the concentration of cyclohexylpyrrolidone. As an illustration, we have obtained dye and FR fixation in this process using CHP concentrations of 25 to 120 percent on weight of fabric with best results at the 50 percent or higher level. Results are also affected by the liquor-to-fabric ratio. Typical liquor-to-fabric ratio for this work has been 15:1, although in production ratios as low as 5:1 may be used with 7:1 considered normal. Residual CHP is removed by heating with water at 130° C.

Fibers suitable for the process of this invention are known generally as aromatic polyamides. This class includes a wide variety of polymers as disclosed in U.S. Pat. No. 4,324,706, the disclosure of which is incorporated by reference. Our experience indicates that not all types of aromatic polyamide fibers can be reproducibly dyed by this process; some fibers are not affected sufficiently by the cyclohexylpyrrolidone to allow the dye to enter the fiber and are only surface stained, not fully dyed. Thus, the fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Our experience indicates that fibers of the para isomer, poly(p-phenyleneterephthalamide) represented commercially by DuPont's Kevlar® and Enka-Glanzstoff's Arenka®, are merely stained or changed in color but are not dyed by the process of this invention. Accordingly, as used in the text of this application and in the claims that follow, the expressions "aramid" and "aromatic polyamide fiber", when pertaining to the novel process of this invention, will signify the meta isomer.

The preferred flame retardant is Antiblaze® 100 (Mobil Oil Corp.) CAS registry number 38051-10-4. It has the following structure:

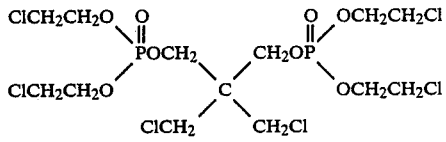

Flame retardant concentrations in the treatment bath from 0.5% to about 20% (based on weight of fabric) are contemplated. However, the upper limit as a practical matter will be determined by the degree of performance required balanced against the cost of the FR chemical or system used. Concentrations in the range of about 3% to about 20% have been shown to be effective in increasing LOI values.

As an assessment of substantivity of the flame retardant and as an indication of durability and washfastness, the phosphorus content of each sample was measured initially and after 25 launderings in hot water using a home washing machine and household laundry detergent.

In the examples that follow, all parts and percentages are by weight and the temperatures reported in °C., unless otherwise indicated.

Limiting Oxygen Index (LOI) is a method of measuring the minimum oxygen concentration expressed as volume % needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited form the top and the length of burning and the time are noted. The oxygen concentration is adjusted, the specimen is re-ignited (or a new specimen inserted), and the test is repeated until the lowest concentration of oxygen needed to support burning is reached.

DESCRIPTION OF THE PREFERRED EMBODIMENTS

Example I

Samples of Nomex T-455, scoured and ready for dyeing, were treated by the conditions of this invention in a laboratory pressure dye machine, Model JF, made by Werner Mathis AG. The fabric, weighing about 100 grams, was loaded into the dye chamber. Dye solution was prepared as follows, all percentages being on weight of fabric:

| | |
|---|---|
| (A) to a beaker was added | |
| Merpol HCS | 1% |
| Basic Blue #77 (pasted with acetic acid) | 3% |
| N—cyclohexyl-2-pyrrolidone | X % |
| the mix was diluted to 600 gm with water | |
| (B) to a second beaker was added | |
| Antiblaze-100 emulsion (30%) | 50% |
| the emulsion was then diluted to 200 gm | |
| (C) to a third beaker was added 500 gm of water | |
| (D) to a fourth beaker was added | |
| sodium nitrate | 18% or 37% |
| water was added to a total of 200 gm | |

Mixes A, B, and C were added to the dye chamber in order with agitation. "D" was then added slowly, with stirring. The mixture was then heated to 130° C. at a rate of approximately 3° C. per minute and held at 130° C. for 6 hours. Variables and results are summarized below:

| Sample | A | B | C | D |
|---|---|---|---|---|
| N—cyclohexyl-2-pyrrolidone | 50% | 50% | 25% | 25% |
| Sodium nitrate | 37% | 18% | 37% | 18% |
| Content, % | | | | |
| Phosphorus %, Initial | 0.65 | 0.62 | 0.50 | 0.45 |
| after 25 Hot La. | 0.46 | 0.54 | 0.34 | 0.38 |
| % Retained | 71 | 87 | 68 | 84 |
| LOI, % | | | | |
| Initial | 29.8 | 32.3 | 38.0 | 41.0 |
| after 25 Hot La. | 38.2 | 38.0 | 33.1 | 33.5 |
| Cross section, Penetration | full | full | ring | ring |

It is clear that a minimum level of CHP is needed for penetration of dye (and Antiblaze-100). It is also clear from weight measurements that CHP is retained in the fiber.

Additional fabric was prepared according to the conditions of Sample B, and was treated with water at 130° C., yielding the following initial LOI's:

| | |
|---|---|
| 5 min | 39.6 |
| 10 min | 40.7 |
| 15 min | 40.7 |
| 20 min | 40.7 |

Treatment at 130° C. for 15 min. was selected for removal of CHP.

Example II

A series of samples was prepared in an Ahiba laboratory dye unit. Nomex® T-450/PBI (80%/20%) fabric was dyed under several conditions illustrating this invention. The total bath was 430 g; fabric weight about 20 g; Merpol HCS, 1%; Basic Blue #77, 3%; sodium nitrate, 25%; all on weight of fabric. The results were as follows:

| Sample | A | B | C | D | E |
|---|---|---|---|---|---|
| N—cyclohexyl-2-pyrrolidone | 60% | 60% | 120% | 120% | 90% |
| Antiblaze 100 emulsion, (30%) | 20% | 40% | 20% | 40% | 30% |

Scoured 15 min. in water at 130° C., dried 1.5 min. at 140° C.

| Results | | | | | |
|---|---|---|---|---|---|
| LOI, Initial, % | 35.3 | 35.3 | 38.9 | 39.6 | 38.9 |
| after 25 Hot La., % | 33.5 | 33.5 | 39.6 | 39.6 | 38.9 |
| Cross section, penetration | poor | poor | good | mod | fair |
| Color | fair | fair | good | mod | mod |

Condition C is a useful treatment. The effect of CHP is paramount, with little effect of AB100 level in this range. It appears that the 30% emulsion exhausts on the fabric very quickly and completely so that the effective concentration does not vary. However, penetration (and durability) vary as does the concentration of CHP as if AB100 acts as a colorless dye. The PBI content was stained rather than effectively dyed.

Example III

T-455 Nomex® was dyed/FR treated in the Ahiba unit already described, using Acid Dye #172 at 4%; Merpol HCS, 1%; acetic acid, 5%; all on weight of fabric.

| Sample | A | B | C | D | E |
|---|---|---|---|---|---|
| N—cyclohexyl-2-pyrrolidone | 60% | 60% | 120% | 120% | 90% |
| Antiblaze 100 emulsion, (30%) | 20% | 40% | 20% | 20% | 30% |
| Cross section, penetration | ring | ring | full | full | full |
| LOI, Initial, % | 33.0 | 34.4 | 32.5 | 33.5 | 32.5 |
| 25 Hot La., % | 32.5 | 35.0 | 35.8 | 36.2 | 36.2 |
| Color | fair | fair | good | good | good |

The results for acid dyeing are not well understood, but do show both relatively good dyeing and a substantial increase in LOI.

What is claimed is:

1. A process of dyeing poly(m-phenyleneisophthalamide) fabric comprising:

(1) dyeing the fabric at about 120° C. to about 150° C. and at elevated pressure in a fiber-dyeing solution containing a tinctorial amount of at least one dye and a dye diffusion promoting amount of N-cyclohexyl-2-pyrrolidone, then (2) heating the fabric while in contact with the solution until the desired degree of dyeing is attained.

2. The process of claim 1, in which the amount of N-cyclohexyl-2-pyrrolidone is from about 25 to about 120 percent weight of fabric.

3. The process of claim 2, in which the ratio of dyeing solution to fabric is from about 20:1 to about 4:1.

4. The process of claim 1, including the additional step of (3) rinsing the fabric and removing any residual N-cyclohexyl-2-pyrrolidone.

5. The process of claim 1, in which the fabric is dyed for about 15 minutes to about 2 hours.

6. An exhaust process for simultaneously dyeing and improving the flame resistance of aramid fibers, comprising the steps of:

(1) dyeing at about 120° C. to about 150° C. and at elevated pressure poly(m-phenyleneisophthalamide) fibers in a dyeing solution containing a tinctorial amount of at least one dye, from about 1% to about 20% by weight of a neutral chloroalkyl disphosphate ester flame retardant and a dye diffusing promoting amount of N-cyclohexyl-2-pyrrolidone, then (2) heating the solution while in contact with the fiber and maintaining contact with the dyeing solution until the desired degree of dyeing or flame resistance or both has been attained, and finally (3) rinsing the fibers to remove any residual flame retardent or dye diffusion promoting agent.

7. The process of claim 6, in which the amount of N-cyclohexyl-2-pyrrolidone is from about 25 to about 120 percent on weight of fabric.

8. The process of claim 6, in which the ratio of dyeing solution to fabric in step (1) is from about 20:1 to about 4:1.

9. The process of claim 6, in which the fabric is treated in step (1) for about 15 minutes to about 2 hours.

10. The process of claim 6, in which the amount of flame retardant applied in step (1) is from about 3% to about 20% on weight of fabric.

11. The process of claim 10, in which the amount of flame retardant applied in step (1) is from about 6% to about 15% on weight of fabric.

12. The process of claim 11, in which the amount of flame retardant applied in step (1) is from 6% to 9% on weight of fabric.

13. A fabric having a Limiting Oxygen Index (ASTM D-2863-77) of greater than 27% in which the poly(m-phenyleneisophthalamide) fibers are simultaneously dyed and flame-retardant treated by the process of claim 6.

14. A dyed, flame-resistant fabric consisting essentially of poly(m-phenyleneisophthalamide) fibers containing within the fiber an amount of neutral chloroalkyl disphosphate ester flame retardant sufficient to impart a Limiting Oxygen Index (ASTM D-28933-77) greater than 27%.

15. The fabric of claim 14, in which the Limiting Oxygen Index is in the range of about 29.8% to about 44%.

16. The fabric of claim 15, in which the Limiting Oxygen Index is in the range of about 37% to 44%.

* * * * *